United States Patent [19]

Wells

[11] Patent Number: 4,766,613

[45] Date of Patent: Aug. 30, 1988

[54] CONVERTIBLE PANTS

[75] Inventor: Brian K. Wells, San Leandro, Calif.

[73] Assignee: David F. Wells, Oakland, Calif.

[21] Appl. No.: 89,140

[22] Filed: Aug. 25, 1987

[51] Int. Cl.[4] ..... A41D 1/06; A41D 27/10

[52] U.S. Cl. ..... 2/227; 2/269; 2/DIG. 6

[58] Field of Search ..... 2/227, 240, 269, DIG. 6

[56] References Cited

U.S. PATENT DOCUMENTS

| | | |
|---|---|---|
| 269,479 | 12/1882 | Stretch et al. . |
| 3,266,057 | 8/1966 | Phelps . |
| 3,994,026 | 11/1976 | Sampey . |
| 4,104,742 | 8/1978 | Rahaim . |
| 4,190,908 | 3/1980 | Herskind . |
| 4,215,435 | 8/1980 | Miele . |
| 4,554,684 | 11/1985 | Cadoret . |

FOREIGN PATENT DOCUMENTS

| | | | |
|---|---|---|---|
| 048477 | 9/1964 | Belgium | 2/240 |
| 2616547 | 11/1977 | Fed. Rep. of Germany | 2/227 |
| 1363957 | 5/1964 | France | 2/227 |
| 454954 | 2/1980 | Italy | 2/227 |

*Primary Examiner*—H. Hampton Hunter

*Attorney, Agent, or Firm*—Bielen and Peterson

[57] ABSTRACT

Trousers having a flexible upper part with two lower portions intending for covering the upper leg of the wearer. The trousers also include a pair of flexible lower parts each intended for encompassing a lower leg of the user. The pair of lower parts is detachably connected to the upper portion lower parts by the use of a pair of strips of pile fastening material connected to the inner surface of the lower portions of the flexible upper part, and a pair of hook fastening material strips connected to the outer surface of the pair of flexible lower parts.

2 Claims, 1 Drawing Sheet

17
14
12
22
16
24
20
50
30
10
18
28
48
40
46
32
34
36
38

18
26
22
44
42
28
48
46
40
36

52
44
44
58

54
48
46
46
56
32

CONVERTIBLE PANTS

BACKGROUND OF THE INVENTION

The present invention relates to a novel construction for trousers which are convertible from long to short modes of wear and visa versa.

It is often necessary for trouser wearers to change from long pants to short pants depending on changing environmental conditions. This task is generally cumbersome and requires the transportation of long and short pants if the user is traveling.

U.S. Pat. Nos. 269,479, 3,266,057, and 4,190,908, describe garments which are convertible from long pants to short pants mode using slide fasteners, hooks, and snaps. These fasteners contact and may irritate the skin portion of the user. In addition, U.S. Pat. No. 4,215,435 describes convertible trousers having a multiplicity of sections connected by snaps which are visible on the exterior of the converted garment.

U.S. Pat. Nos. 3,994,026, 4,104,742, and 4,554,684 describe garments employing Velcro type connections to form, rather than to convert, a garment.

Trousers which are convertible from short to long without discomfort to the wearer would be a notable advance in the garment industry.

SUMMARY OF THE INVENTION

In accordance with the present invention a novel and useful trouser construction is provided.

The trousers are intended for use with a human torso and include an upper flexible part having a portion intended for surrounding the torso waist. A pair of lower portions are also included for substantially encompassing the upper legs of the torso and extend from the torso waist surounding portion. Each of the lower portions of the flexible upper part include an outer surface and inner surface, which is capable of contacting the torso leg. An edge portion is also found between the inner and outer surfaces of each of the lower portions.

The invention further includes a pair of flexible lower parts, each intended for substantially encompassing a torso lower leg. Again, each of the lower parts has an outer surface, an inner surface, and an edge portion between the outer and inner surfaces.

Means is also provided for detachably connecting each of the lower parts to each one of the lower portions of the flexible upper part. Such means takes the form of a pair of strips of pile fastening material connected to the inside surface of each of the lower portions of the flexible upper part. A pair of strips of hook fastening material is fixed or connected to the outer surface of each of the pair of flexible lower parts. The pair of pile strips fastened to the inner surface of each of the lower portions of the flexible upper part are spaced a predetermined distance from the edge portions located between the inner and outer surfaces, of the same.

In addition, the trousers of the present invention may be constructed such that each strip of hook fastening material on each flexible lower part includes a gap which brackets a seam extending from the edge portion across the outer surface, thereof. Likewise, each flexible lower portion of the flexible upper part may be constructed such that the strip of pile fastening material is defined to include a gap across a seam extending from the edge portion across the inner surface, thereof. In this manner, alignment of the corresponding lower part and lower portion may be accurately effected when converting the trousers from the short to the long mode.

It may be apparent that a novel and useful trousers has been described.

It is therefore and object of the present invention to provide trousers which may be easily converted from the short to the long pants mode.

It is another object of the present invention to provide trousers which are convertible from the long to the short pants mode and visa versa, but may be worn in the short pants mode without discomfort to the user.

Yet another object of the present invention is to provide trousers which may be converted from the short to the long pants mode easily and accurately to provide a pleasing esthetic appearance.

The invention possesses other objects and advantages especially as concerns particular characteristics and features thereof which will become apparent as the specification continues.

Figure 1:
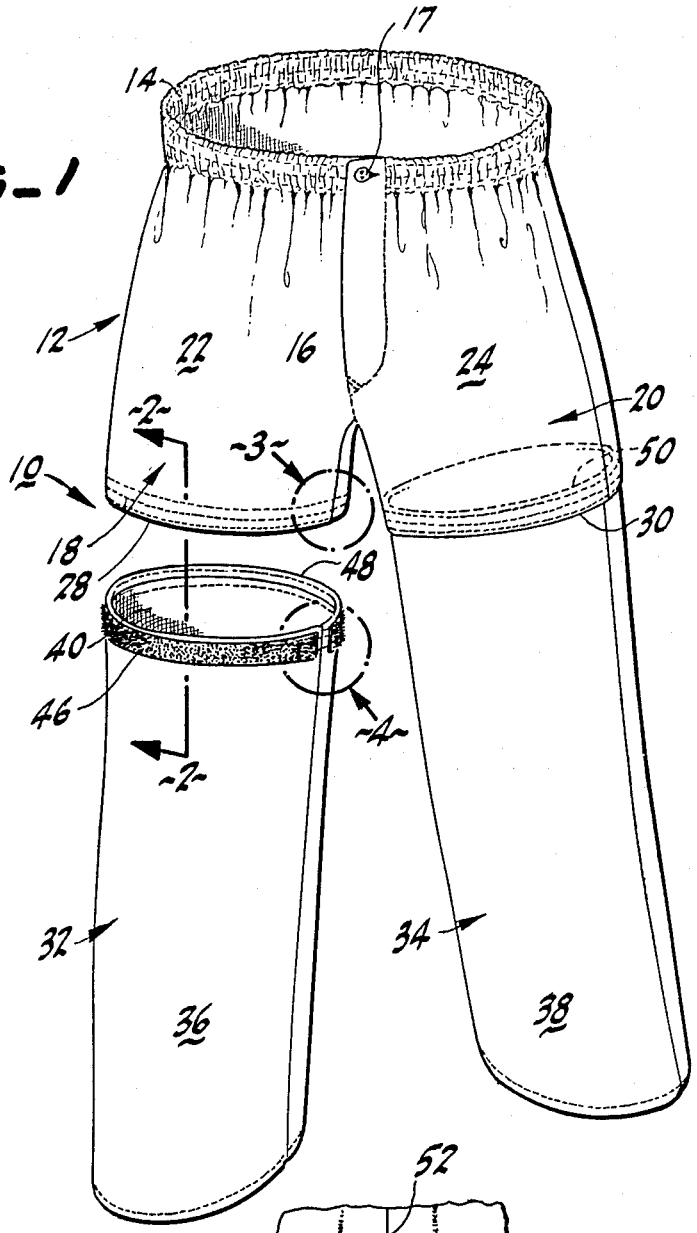
FIG. 1 is a perspective view of the present invention showing one pant leg in exploded configuration.

For better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments, thereof, which should be referenced to the above described drawings.

The invention as a whole is depicted in the drawings by referenced character 10. The trousers 10 includes as one of its elements a flexible upper part 12. Upper 12 includes a waist band 14 having elastic material enclosed. A fly 16 is also found in upper part 12 and is provided with a button closure 17, in the conventional manner. Upper part 12 further includes a pair of lower portions 18 and 20 which are intended for encompassing the upper leg portion of a human torso. Lower portions 18 and 20 extend from waist portion 14 and include an outer surfaces 22 and 24 and inner surfaces such as inner surface 26 and another (not shown), respectively. Edge portions 28 and 30 are found between inner surfaces 26 and another (not shown) and outer surfaces 22 and 24 of lower portions 18 and 20, respectively.

The invention also includes a pair of flexible lower parts 32 and 34. Lower parts 32 and 34 are intended for encompassing the lower leg portion of a human torso. Lower parts 32 and 34 include outer surfaces 36 and 38, as well as inner surfaces 40 and another (not shown), respectively. It should be noted that lower portions 18 and 20 are a mirror image of one another. The same relationship exist between lower parts 32 and 34. In general, trousers 10 may be constructed of cloth or similar material.

Means 42 is also provided for detachably connecting lower parts 32 and 34 to lower portions 18 and 20 of upper part 12. In the drawings, means 42 is illustrated in relation to lower portion 18 and lower part 32. However, identical means is employed for detachably connecting lower part 34 to lower portion 20. Means 42, relative to lower part 32 and lower portion 18 includes a strip of pile fastening material 44 sewn to the inside surface 26 of lower portion 18, FIG. 2. It should be noted that the bitter end of edge portion 28 of lower portion 18 is folded upwardly beneath pile strip 44. A strip of hook material 46 is sewn to edge portion 48 of lower part 32. It may be apparent that lower part 34 also includes an edge portion 50, shown in phantom FIG. 1. Hook strip 46 and pile strip 44 may be of the Velcro type closure, intended for securely engaging one another when in contact.

Figure 2:
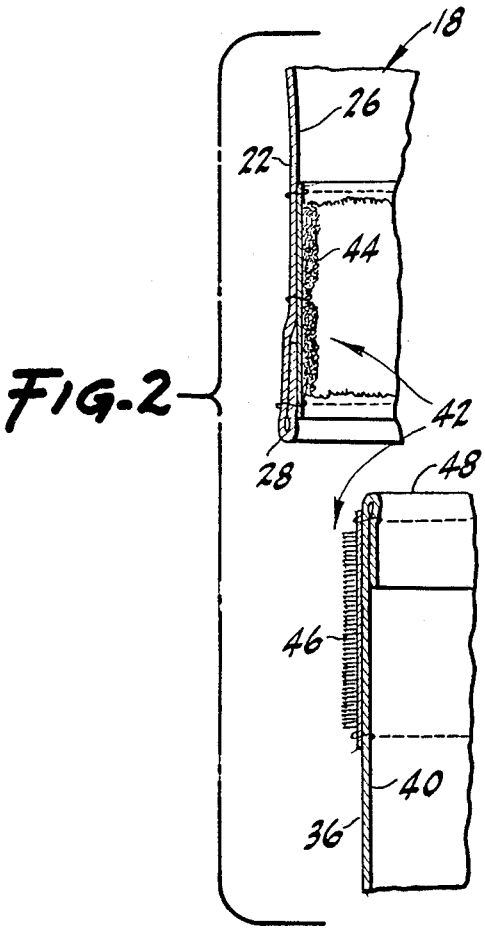
FIG. 2 is a sectional view taken along line 2—2 of FIG. 1.
Figure 3:
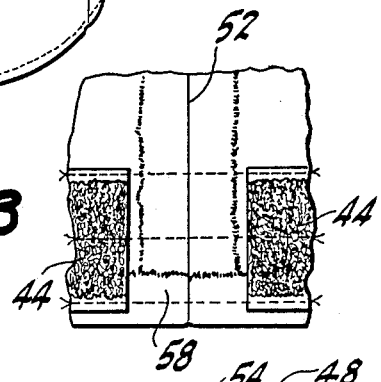
FIG. 3 is a broken, enlarged view of a portion of FIG. 1.
Figure 4:
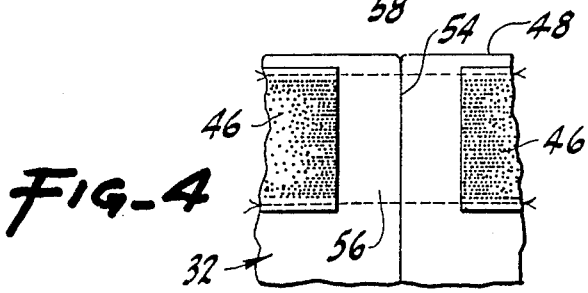
FIG. 4 is a broken, enlarged view of a portion of FIG. 1.

With reference to FIG. 1, lower portion 18 and lower part 32 are illustrated as possessing inner seams 52 and 54, respectively. Lower portion 20 and lower part 34 also are constructed with such an inner seam. Strip 46 is formed with a gap 56 which brackets seam 54. Likewise, strip 44 on lower portion 48 is formed with a gap 58 which brackets seam 52. Gaps 56 and 58 permit alignment of seam 54 of lower part 32 with seam 52 of lower portion 18 when converting trousers 10 from the short pants mode to the long pants mode.

In operation, the user may wear upper part 12 around the waist and upper leg portion of the user's torso. Lower parts 32 and 34, which are intended to encompass the lower leg portion of the user's torso may be affixed to upper part 12 by the use of Velcro strips 44 and 46 found on lower part 32 and lower portion 18. Other hook and pile strips associated with lower part 34 and lower portion 20 (not shown) are employed to connect the same. Gaps 56 and 58 of strips 46 and 44 permit easy alignment of lower part 32 and lower portion 18, in this procedure. Of course, such gaps may also exist with the hook and pile strips used in conjunction with lower part 34 and lower portion 20. By reversing the above steps, lower parts 32 and 34 may be removed from lower portions 18 and 20 to convert trousers 10 to the short pants mode. Lower parts 32 and 34 may be easily stored while traveling.

While in the foregoing, embodiments of the present invention have been set forth in considerable detail for the purpose of making a complete disclosure of the invention, it may be apparent to those of skill in the art that numerous changes may be made in such details without departing from the spirit and principles of the invention.

What is claimed is:

1. Trousers intended for use with a human lower torso comprising:

a. a flexible upper part having a portion intended for surrounding the torso waist and a pair of lower portions, each of said pair of lower portions intended for substantially encompassing a torso leg and extending from said torso waist surrounding portion, each of said lower portions of said flexible upper part including an outer surface, an inner surface, each capable of contacting a torso leg, and an edge portion between said inner and outer surfaces, each of said lower portions of said flexible upper part further including a substantially vertical seam;

b. a pair of flexible lower parts, each intended for substantially encompassing a torso lower leg, each of said lower pants having an outer surface, an inner surface, and an edge portion therebetween, each of said pair of flexible lower parts further including a seam;

c. means for detachably connecting each of said lower parts to each one of said lower portions of said flexible upper part, said means comprising a pair of strips of pile fastening material connected to said inside surface of each of said lower portions of said flexible upper part, and a pair of strips of hook fastening material connected to the outer surface of each of said pair of flexible lower parts, said strips of pile material extending substantialy parallel to the majority of said edge portions of each of said lower portions of said flexible upper part, said strips of hook material extending substantially parallel to the majority of said edge portions of each pair of flexible lower parts; and d. alignment means for orienting said seams of each of said lower portions of said flexible upper part with a substantially vertical seam of one of said pair of flexible lower parts, including each of said strips of hook and pile fastening material stopping short of its respective substantially vertical seam to provide a gap whereby alignment of said gaps provide for alignment of said seams.

2. The trousers of claim 1 in which said pair of pile strips of fastening material connected to said inner surface of each of said lower portions of said flexible upper part are spaced a predetermined distance from each of said edge portions thereof.

* * * * *